US007503097B2

(12) United States Patent
Kim et al.

(10) Patent No.: US 7,503,097 B2
(45) Date of Patent: Mar. 17, 2009

(54) TRAVELING EQUIPMENT FOR CLEANER

(75) Inventors: Sang-Young Kim, Gyeonggi-Do (KR); Jun-Young Lim, Incheon (KR); Yong-Won Choi, Daejeon (KR)

(73) Assignee: LG Electronics Inc., Seoul (KR)

( * ) Notice: Subject to any disclaimer, the term of this patent is extended or adjusted under 35 U.S.C. 154(b) by 791 days.

(21) Appl. No.: 11/068,796

(22) Filed: Mar. 2, 2005

(65) Prior Publication Data

US 2006/0021182 A1 Feb. 2, 2006

(30) Foreign Application Priority Data

Jul. 27, 2004 (KR) ..... 10-2004-0058735

(51) Int. Cl.
*A47L 5/28* (2006.01)

(52) U.S. Cl. ..... 15/340.2; 15/319; 15/410; 15/DIG. 10

(58) Field of Classification Search ..... 15/319, 15/340.2, 410, DIG. 10; *A47I 5/28*
See application file for complete search history.

(56) References Cited

U.S. PATENT DOCUMENTS 3,618,687 A 11/1971 Ripple et al.
3,854,164 A 12/1974 Schmitz
3,931,662 A * 1/1976 Nayfa et al. ..... 15/320
4,342,369 A * 8/1982 Ransom ..... 180/19.3
4,624,027 A 11/1986 Martin
4,845,803 A 7/1989 King
6,282,747 B1 * 9/2001 Morgan et al. ..... 15/340.2
7,043,784 B2 * 5/2006 Plannerer ..... 5/601
7,222,390 B2 * 5/2007 Cipolla et al. ..... 15/340.2

* cited by examiner

*Primary Examiner*—David A Redding
(74) *Attorney, Agent, or Firm*—Greenblum & Bernstein, P.L.C.

(57) ABSTRACT

Traveling equipment for a cleaner comprises: a traveling motor mounted to a cleaner head part and for generating a normal torque and a reverse torque; a traveling shaft penetrated and coupled to the traveling motor and supplied with the torque of the traveling motor; traveling wheels coupled to both sides of the traveling shaft; an operation mode selection means for selectively regulating the automatic back and forth operation function and manual function; a control means for outputting a control signal upon receiving a signal selected by the operation mode selection means; and a driving means for driving the traveling motor upon receiving the control signal of the control means. By this, the user's convenience is raised and the simplicity of the components is acquired.

8 Claims, 6 Drawing Sheets

TRAVELING EQUIPMENT FOR CLEANER

BACKGROUND OF THE INVENTION

1. Field of the Invention

The present invention relates to a cleaner, and more particularly to, traveling equipment for a cleaner which can raise user's convenience and realize the simplicity of components.

2. Description of the Background Art

Generally, a cleaner serves to remove dust or foreign material put in set areas such as a living room, room, etc. by using a motor for converting electric energy into kinetic energy and a fan mounted to the motor and for generating a suction force while rotating.

The cleaner commonly includes a main body part for generating a suction force, a head part connected to the main body part and for sucking foreign material on a surface to be cleaned, and a handle part for handling the motion of the head part. The cleaner is classified into various types according to the arrangement and construction of the main body part, head part and handle part.

FIG. 1 is a perspective view illustrating one example of an upright vacuum cleaner.

As illustrated therein, the upright vacuum cleaner comprises a head part 100, a main body part 200 connected to the head part 100 in vertical direction, and a handle part 300 consecutively connected to the main body part 200. The head part 100 is provided with traveling equipment incorporating traveling wheels.

The traveling equipment includes a traveling shaft (not shown) rotatably mounted to the head part 100, traveling wheels 110 coupled to both opposite ends of the traveling shaft, a power transmission means for transmitting a power of a main motor (not shown) constituting the main body part 200 to the traveling shaft, and a rotation direction conversion means for selectively converting a direction of a torque transmitted by the power transmission means.

The rotation direction conversion means is constructed of a mechanism incorporating a clutch operated by handling of the handle part 300.

The main motor is connected to a fan (not shown) for generating a suction force, and rotates in only one direction.

In the upright vacuum cleaner as set forth above, when a power is supplied by pressing an operating button, a suction force is generated while the fan is rotating along with the operation of the main motor constituting the main body part 200, and foreign material such as dust or dirt is sucked through the head part 100 by the suction force generated from the main body part 200.

At the same time, a driving force of the main motor is transmitted to the traveling shaft and traveling wheels 110 through the power transmission means to thus rotate the traveling wheels 110. The traveling wheels 110 normally rotates and reversely rotates with the torque transmitted from the main motor being converted using the rotation direction conversion means. The rotation direction conversion means is handed by using the handle part 300.

With the normal rotation or reverse rotation of the traveling wheels 100, the cleaner moves forward or backward to thus suck foreign material such as dust or dirt place on the floor face through the head part 100. The user carries out a cleaning by adjusting the traveling direction while holding the handle part 300 in a standing posture without bending the waist.

The forward and backward movement of the traveling equipment for the cleaner during the forward and backward movement of the cleaner will now be explained more concretely.

FIG. 2 is a front view illustrating the forward operating state of conventional traveling equipment.

As illustrated therein, in case the traveling equipment makes a forward move, the user firstly pushes parts of the handle part 300 in a downward direction. When parts of the handle part 300 are pushed downward, a first connecting rod 121 connected to the handle part 300 is pushed downward. As the first connecting rod 121 is pushed down, a second connecting rod 122 hingeably coupled with the first connecting rod 121 is moved to thus move a first friction clutch 123 connected to the second connecting rod 122 to the left. As the first friction clutch 123 is moved to the left, the first friction clutch 123 is tightly contacted with a first friction disc 124 disposed at the left of the first friction clutch 123. And a second friction clutch 125 integral with the first friction clutch 123 is separated from the second friction disc 126 disposed at the right thereof.

In this state, a torque of the main motor 210 is transmitted to an intermediate rotary shaft 127 by a belt 220, and a torque of the intermediate rotary shaft 127 is transmitted to the traveling shaft 128 and the left traveling wheel 111 through the first friction clutch 123, first friction disc 124 and first gear box B1.

FIG. 3 is a side view illustrating a gear train constituting a first gear box.

As illustrated therein, when the first friction clutch 123 is tightly contacted to the first friction disc 124, a torque of the intermediate rotary shaft 127 is transmitted to the traveling shaft 128 through a first gear 131, a second gear 132 engaging with the first gear 131 and a third gear 133 engaging with the second gear 132 by means of the first friction disc 124. By this, the traveling wheels 110 coupling to the traveling shaft 128 normally rotate.

FIG. 4 is a front view illustrating the backward operating state of the conventional traveling equipment.

As illustrated therein, in case the traveling equipment makes a backward move, the user firstly pulls parts of the handle part 300 in an upward direction. When parts of the handle part 300 are pulled upward, the first connecting rod 121 connected to the handle part 300 is pushed upward. As the first connecting rod 121 is pushed upward, the second connecting rod 122 hingeably coupled with the first connecting rod 121 is moved to thus move the second friction clutch 125 connected to the second connecting rod 122 to the right. As the second friction clutch 125 is moved to the right, the second friction clutch 125 is tightly contacted with the second friction disc 126 disposed at the right of the second friction clutch 125. And the first friction clutch 123 integral with the second friction clutch 125 is separated from the first friction disc 124 disposed at the left of the first friction clutch 123.

In this state, a torque of the main motor 210 is transmitted to the intermediate rotary shaft 127 by the belt 220, and a torque of the intermediate rotary shaft 127 is transmitted to the traveling shaft 128 and the right traveling wheel 112 through the second friction clutch 125, second friction disc 126 and second gear box B2.

FIG. 5 is a side view illustrating a gear train constituting a second gear box.

As illustrated therein, when the second friction clutch 125 is tightly contacted to the second friction disc 126, a torque of the intermediate rotary shaft 127 is transmitted to the traveling shaft 128 through a fourth gear 134, a fifth gear 135 engaging with the fourth gear 134 and a sixth gear 136 engaging with the fifth gear 135 and a seventh gear 137 engaging with the sixth gear 136 by means of the second friction disc 126. By this, the traveling wheels 110 coupling to the traveling shaft 128 reversely rotate.

However, since the aforementioned conventional traveling equipment for the cleaner is arranged to move forward or backward by handling the handle part 300 when a user carries out a cleaning using the cleaner, forward and backward moves are continuously made iteratively when doing the cleaning while moving back and forth in a given area, thereby causing inconvenience to the user.

Besides, the assembling productivity is low due to a large number of components and complexity, and the manufacturing cost is high.

SUMMARY OF THE INVENTION

Therefore, an object of the present invention is to provide traveling equipment for a cleaner which can raise user's convenience and realize the simplicity of components.

To achieve these and other advantages and in accordance with the purpose of the present invention, as embodied and broadly described herein, there is provided traveling equipment for a cleaner, comprising: a traveling motor mounted to a cleaner head part and for generating a normal torque and a reverse torque; a traveling shaft penetrated and coupled to the traveling motor and supplied with the torque of the traveling motor; traveling wheels coupled to both sides of the traveling shaft; an operation mode selection means for selectively regulating the automatic back and forth operation function and manual function; a control means for outputting a control signal upon receiving a signal selected by the operation mode selection means; and a driving means for driving the traveling motor upon receiving the control signal of the control means.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, traveling equipment for a cleaner according to the present invention will be described in detail with reference to embodiments as illustrated in the accompanying drawings.

Figure 1:
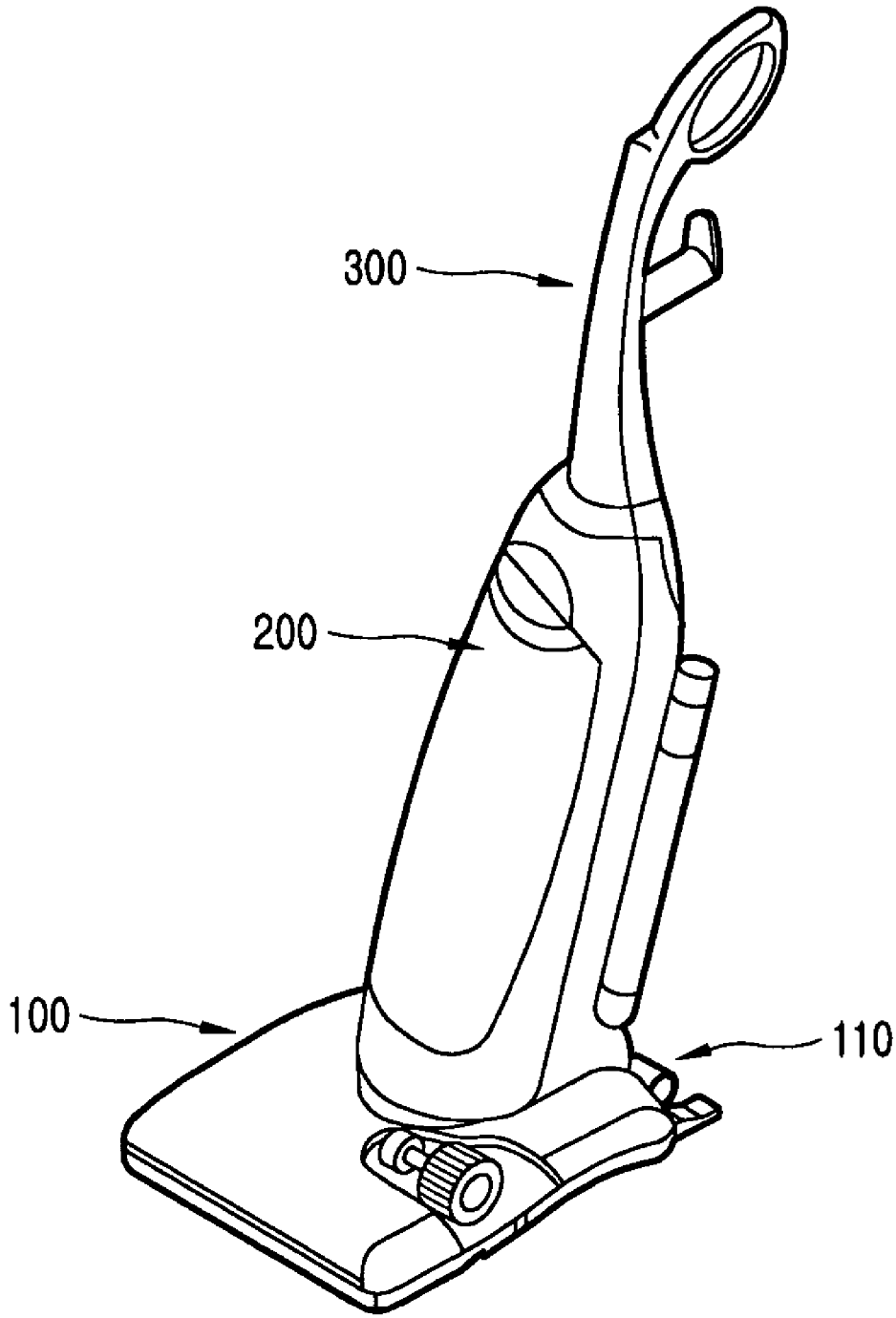
FIG. 1 CONVENTIONAL ART
FIG. 1 is a perspective view illustrating one example of a general upright vacuum cleaner.
Figure 2:
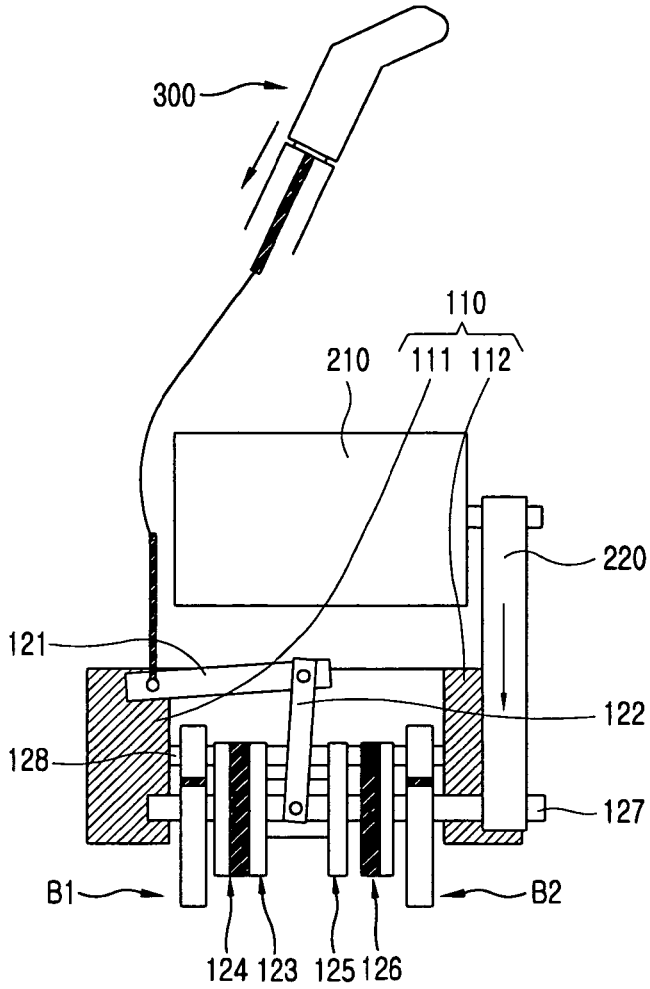
FIG. 2 CONVENTIONAL ART
FIG. 2 is a front view illustrating the forward operating state of conventional cleaner traveling equipment.
Figure 3:
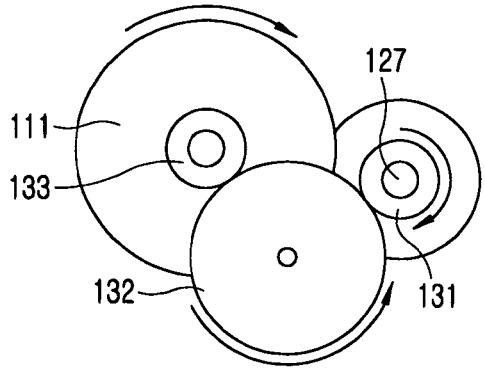
FIG. 3 CONVENTIONAL ART
FIG. 3 is a side view illustrating a gear train constituting a first gear box.
Figure 4:
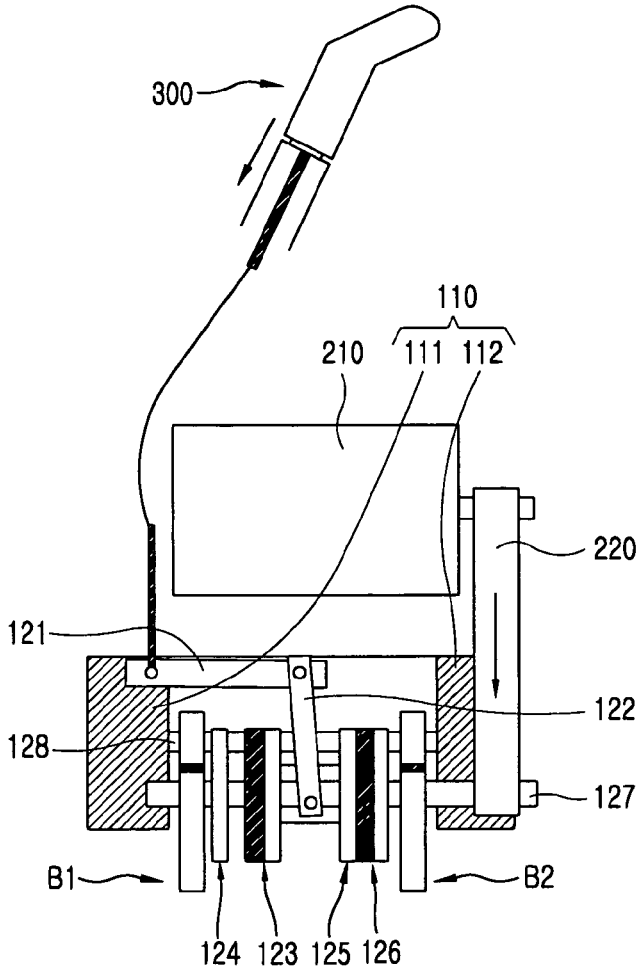
FIG. 4 CONVENTIONAL ART
FIG. 4 is a front view illustrating the backward operating state of the cleaner traveling equipment.
Figure 5:
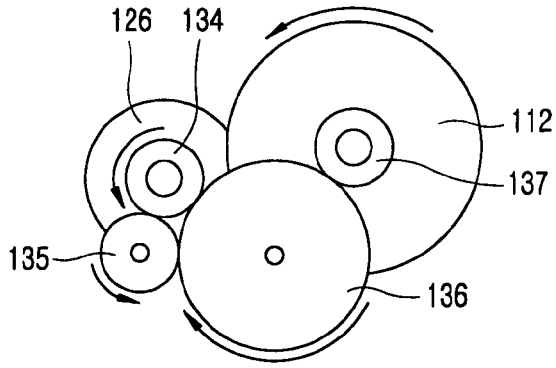
FIG. 5 CONVENTIONAL ART
FIG. 5 is a side view illustrating a gear train constituting a second gear box.
Figure 6:
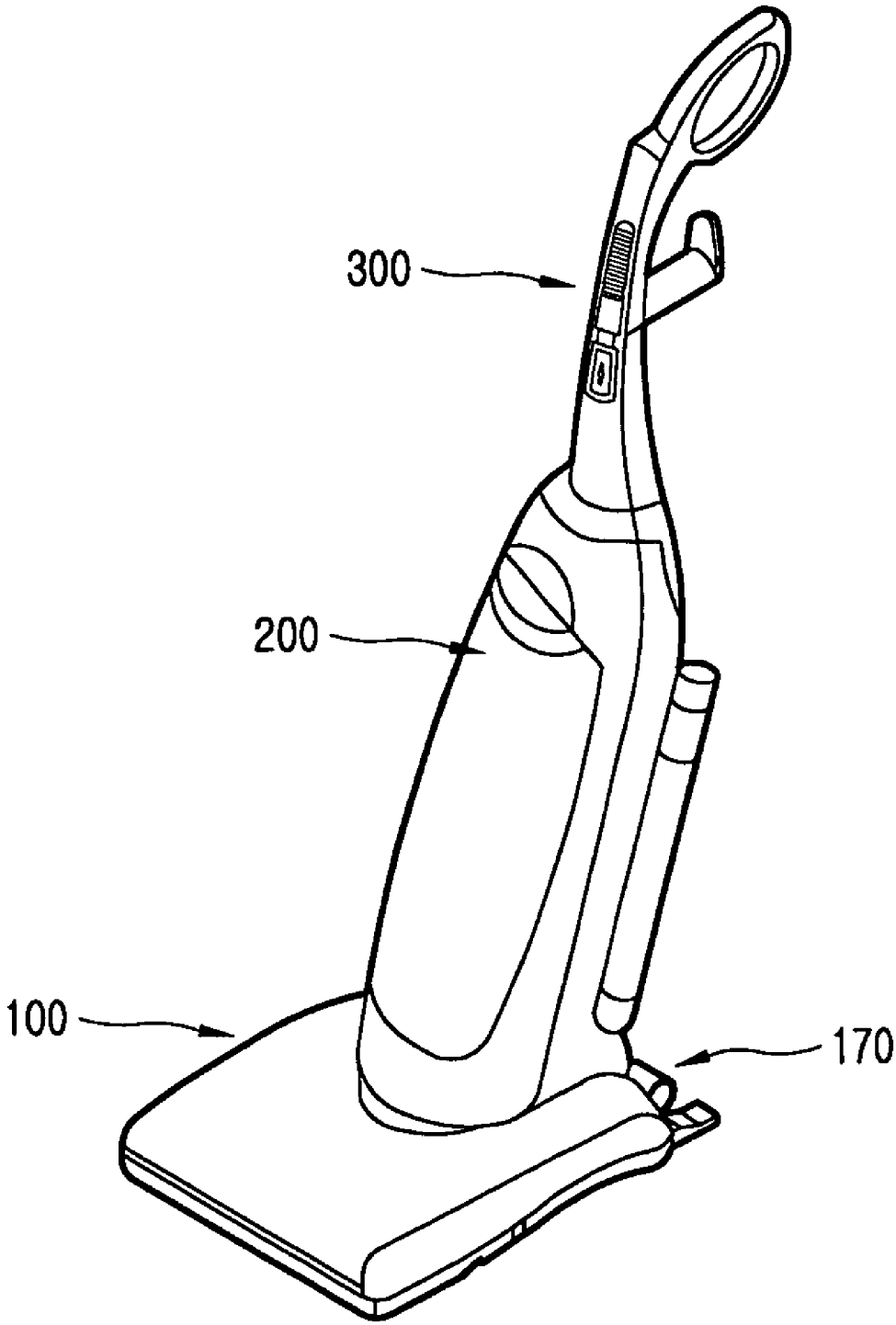
FIG. 6 is a perspective view illustrating a cleaner with cleaner traveling equipment according to the present invention.
Figure 7:
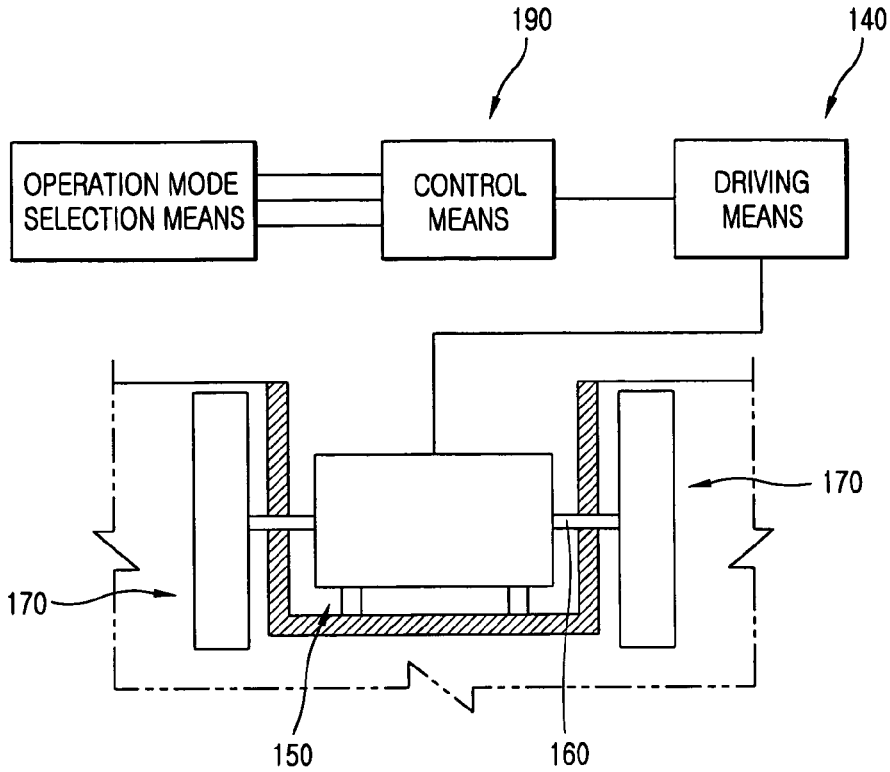
FIG. 7 is a block diagram illustrating one embodiment of the cleaner traveling equipment according to the present invention.

FIG. 6 is a perspective view illustrating a cleaner with one embodiment of cleaner traveling equipment according to the present invention. FIG. 7 is a block diagram illustrating the traveling equipment for the cleaner.

As illustrated therein, the cleaner comprises a main body part for generating a suction force, a head part 100 coupled to the lower end of the main body part 200 and for sucking dust or foreign material by the suction force generated from the main body part 200, and a handle part 300 consecutively connected to the main body part 200.

The traveling equipment includes a traveling motor 150 mounted to the head part 100 and for generating a normal torque and a reverse torque, a traveling shaft 160 penetrated and coupled to the traveling motor 150 and supplied with the torque of the traveling motor 150, traveling wheels 170 coupled to both sides of the traveling shaft 160, an operation mode selection means for selectively regulating the automatic back and forth operation function and manual function, a control means 190 for outputting a control signal upon receiving a signal selected by the operation mode selection means, and a driving means 140 for driving the traveling motor 150 upon receiving the control signal of the control means 190.

The traveling motor 150 is a direct current motor.

Figure 8:
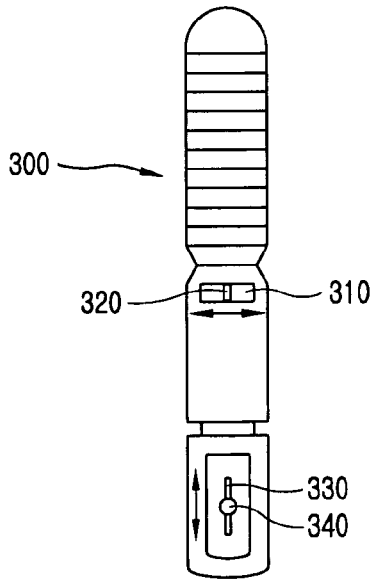
FIG. 8 is a plane view illustrating a handle part of the cleaner.

The operation mode selection means is provided at the handle part 300. The operation mode selection means has, as illustrated in FIG. 8, an indicator hole 310 having a given width and length is formed at one side of the handle part 300, and an operation mode switch 320 is slidably coupled to the inside of the indicator hole 310. The longitudinal direction of the indicator hole 310 is a transverse direction, and the operation mode switch 320 is moved transversely in the indicator hole 310. When the operation mode switch 320 is moved to one side, the automatic back and forth operation mode is selected, and if the operation mode switch 320 is moved to the opposite side, the manual operation mode is selected.

The manual operation mode is the mode at which the user can select and utilize the forward and backward traveling of the cleaner during a cleaning, while the automatic back and forth operation mode is the mode at which the cleaner cleans a given surface area while automatically traveling back and forth.

Further, a sliding hole 330 having a given width and length is formed at the handle part 300, and a travel distance control switch 340 is slidably coupled to the inside of the sliding hole 330. The longitudinal direction of the sliding hole 330 is a vertical direction, and the travel distance control switch 340 is moved vertically in the sliding hole 330.

The back-and-forth distance of the cleaner is controlled by moving the travel distance control switch 340 up and down, with the operation mode switch 320 being in the automatic back and forth operation mode. That is, a number of rotations of the traveling motor 150 is changed according to the movement of the travel distance control switch 340 to thus control the back-and-forth distance of the traveling wheels 170.

The value of a variable resistance is changed according to the moving distance of the travel distance control switch 340, the value of a time constant is changed according to the change in resistance value, and a signal corresponding to the change in time constant is output to the control means 190.

If parts of the handle part 300 are coupled so as to be movable in a sliding manner, and the user pulls or pushes these parts of the handle part 300, a terminal for forward movement and a terminal for backward movement that are disposed inside the handle part 300 are selectively turned on/off and their selection signal is transmitted to the control means 190. The driving means 140 normally rotates or reversely rotates the traveling motor 150 according to this signal.

Figure 9:
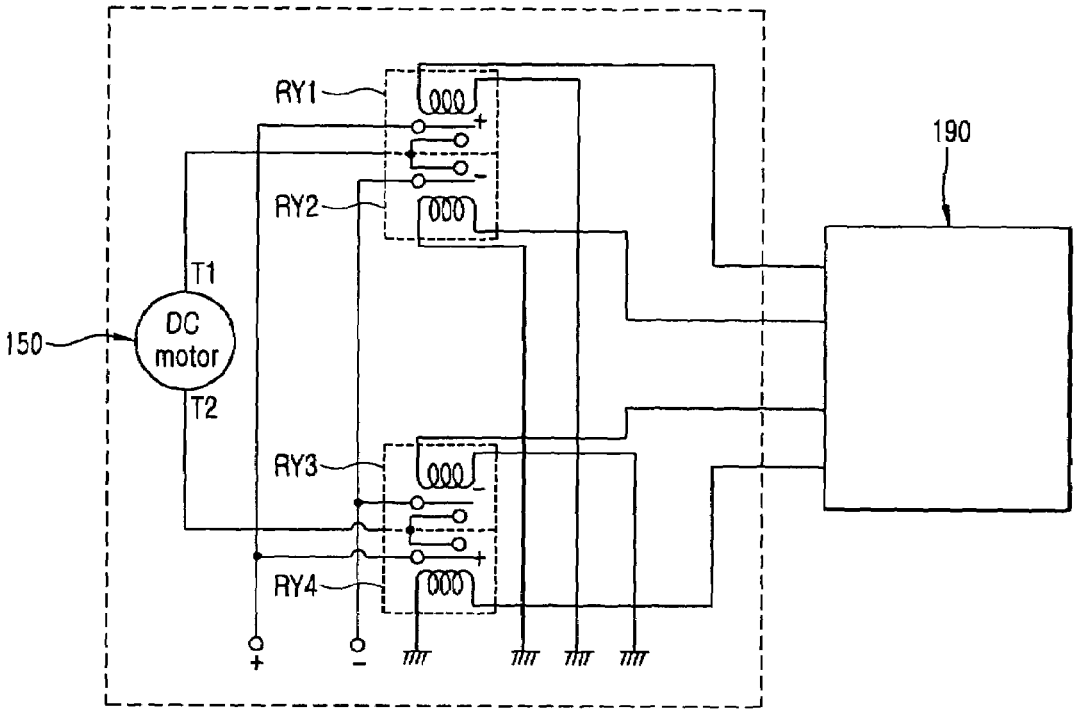
FIG. 9 is a circuit diagram illustrating one example of a traveling motor and a driving means constituting the cleaner traveling equipment of the present invention.

FIG. 9 is a circuit diagram illustrating the traveling motor and driving means.

The driving means 140 normally rotates or reversely rotates the traveling motor 150 under control of the control means 190.

The traveling motor 150 is a direct current motor. The driving means 140 includes first and second relays RY1 and RY2 selectively driven upon receiving a control signal from the control means 190 so that a voltage of a first polarity is applied to a first terminal T1 of the direct current motor, and third and fourth relays RY3 and RY5 selectively driven upon receiving a control signal from the control means 190 so that a voltage of a second polarity opposite to the first polarity is applied a second terminal T2 of the direct current motor.

In case the traveling motor 150, i.e., the direct current motor, rotates in normal direction, if the control means 190 applies a control signal to the first relay RY1 and third relay RY3, the first relay RY1 and third relay RY3 are driven. As the first relay RY1 and third relay RY3 are driven, a constant voltage (+V) is applied to the first terminal T1 of the direct current motor and a auxiliary voltage (−V) is applied to the second terminal T2 thereof. Therefore the traveling motor 150, i.e., the direct current motor, rotates in normal direction.

Additionally, in case the traveling motor 150, i.e., the direct current motor, rotates in reverse direction, if the control means 190 applies a control signal to the second relay RY2 and fourth relay RY4, the second relay RY2 and fourth relay RY4 are driven. As the second relay RY2 and fourth relay RY4 are driven, a auxiliary voltage (−V) is applied to the first terminal T1 of the direct current motor and a constant voltage (+V) is applied to the second terminal T2 thereof. Therefore the traveling motor 150, i.e., the direct current motor, rotates in reverse direction.

Figure 10:
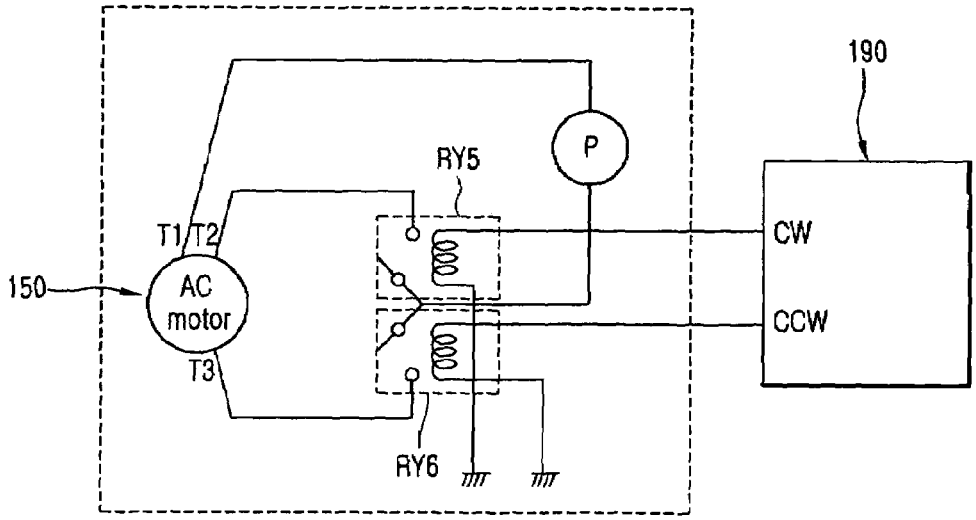
FIG. 10 is a circuit diagram illustrating another example of a traveling motor and driving means constituting the cleaner traveling equipment of the present invention.

FIG. 10 is a circuit diagram illustrating another example of the traveling motor and driving means.

As illustrated therein, the traveling motor 150 is an alternating current motor. The driving means 140 forms a closed loop when a first terminal T1 of an alternating current motor is constantly connected to an alternating current power source, and a second terminal T2 or third terminal T3 of the alternating current motor is selectively connected to the alternating current power source by fifth and sixth relays RY5 and RY6, which are a pair of relays driven upon selectively receiving a normal direction driving signal or reverse direction driving signal of the control means 190.

In case the traveling motor 150, i.e., the alternating current motor, rotates in normal direction, the control means 190 outputs a normal direction driving signal CW to the fifth relay RY5. Therefore, the fifth relay RY5 is turned on and the sixth relay RY6 is turned off to thus apply a power P to a loop connected to the first terminal T1 and second terminal T2, thereby rotating the traveling motor 150, i.e., the alternating current motor, in normal direction.

In case the traveling motor 150, i.e., the alternating current motor, rotates in reverse direction, the control means 190 outputs a reverse direction driving signal CCW to the sixth relay RY6. Therefore, the sixth relay RY6 is turned on and the fifth relay RY5 is turned off to thus apply a power P to a loop connected to the first terminal T1 and third terminal T3, thereby rotating the traveling motor 150, i.e., the alternating current motor, in reverse direction.

The operational effects of the cleaner traveling equipment of the present invention will now be described.

Firstly, in case the user wants to clean a given area in automatic mode, the user flips the operation mode switch 320 to set it to the automatic back and forth operation mode. When the automatic back and forth operation mode is set, its signal is transmitted to the control means 190 and the control means 190 sends a control signal corresponding to the automatic back-and-forth operation mode to the driving means 140. The driving means 140 iteratively performs normal and reverse rotations of the traveling motor 150 according to the control signal sent from the control means 190.

As the traveling motor 150 iteratively performs normal and reverse rotations, the torque of the traveling motor 150 is transmitted to the traveling shaft 160 and the traveling wheels 170, and thus the traveling wheels 170 moves back and forth iteratively. As the traveling wheels 170 moves back and forth iteratively, the cleaner automatically moves back and forth in an area to be cleaned and cleans the area.

In case of controlling the back-and-forth distance of the cleaner, the travel distance control switch 340 is flipped up and down to control the back-and-forth distance. The back-and-forth distance becomes longer or shorter in proportion to the flipping distance of the travel distance control switch 340. When the travel distance control switch 340 is flipped, a signal is transmitted to the driving means 140 through the control means 190 according to the flipping of the travel distance control switch 340. Thus the driving means 140 controls the number of rotations of the traveling wheels 170 by controlling the number of normal rotations and number of reverse rotations of the traveling motor 150. As the number of normal rotations and number of reverse rotations of the traveling motor 150 are controlled, the back-and-forth distance of the cleaner is controlled.

On the other hand, in case the user wants to operate the cleaner in manual mode, the user flips the operation mode switch 320 to set it to the manual operation mode. With the manual operation mode being set, the user cleans an area to be cleaned while moving the cleaner back and forth by pushing or pulling parts of the handle part 300 to thus contact them to the terminal for forward movement or terminal for backward movement. When the terminal for forward movement is connected, its signal is transmitted to the control means 190 and the control means 190 sends a control signal to the driving means 140, thereby rotating the traveling motor 150 in normal direction. As the traveling motor 150 rotates in normal direction, its torque is transmitted to the traveling shaft 160 and the traveling wheels 170, and the traveling wheels 170 rotate in normal direction to thus move the cleaner forward. When the terminal for backward movement is connected, the above same process is performed, and the traveling wheels 170 reversely rotate to thus move the cleaner backward.

As explained above, by manipulating the switch in a simple way, it is made possible for the cleaner to clean a given area while automatically moving back and forth, and further to control the back-and-forth distance.

Additionally, the components has simplicity since the traveling equipment is constructed of several chips or substrates including the traveling motor 150, traveling shaft 160 and traveling wheels 170.

In this way, the cleaner traveling equipment of this invention enables the cleaner to perform a cleaning while automatically moving back and forth in an area to be cleaned by the user's manipulating the switch in a simple way, thereby raising the user's convenience.

Furthermore, owing to the simplicity of the components, it is easy to assemble them, and this increases the assembly productivity.

What is claimed is:

1. A traveling equipment for a cleaner, comprising:

a traveling motor mounted to a cleaner head part and generating a normal torque and a reverse torque;

a traveling shaft penetrated and coupled to the traveling motor and supplied with the torque of the traveling motor;

traveling wheels coupled to both sides of the traveling shaft;

an operation mode selector that selectively regulates the automatic back-and-forth operation function and manual function;

a controller that outputs a control signal upon receiving a signal selected by the operation mode selector; and a driving device that drives the traveling motor upon receiving the control signal of the controller;

wherein the operation mode selector is an operation mode switch for selectively setting the automatic back-and-forth operation mode and the manual mode which is disposed to be movable within a given distance and performs the automatic back-and-forth operation function according to the moving direction thereof; and wherein the operation mode selector has the back-and-forth distance control function added thereto for controlling a back-and-forth distance in the automatic back-and-forth operation mode.

2. The traveling equipment of claim 1, wherein the back-and-forth distance control function is performed by a travel distance control switch mounted to the handle part of the cleaner, and the back-and-forth distance of the traveling wheels is determined according to the moving distance of the travel distance control switch.

3. The traveling equipment of claim 2, wherein the value of a variable resistance is changed according to the moving distance of the travel distance control switch, the value of a time constant is changed according to the change in resistance value, and a signal corresponding to the change in time constant is output to the controller.

4. The traveling equipment of claim 2, wherein the travel distance control switch moves in the longitudinal direction of the cleaner handle part.

5. The traveling equipment of claim 1, wherein the operation mode selector can select normal rotation and reverse rotation of the traveling motor in the manual operation mode.

6. The traveling equipment of claim 1, wherein the operation mode selector is provided at the cleaner handle part.

7. The traveling equipment of claim 1, wherein the traveling motor is a direct current motor, and the driving device includes first and second relays selectively driven upon receiving a control signal from the controller so that a voltage of a first polarity is applied to a first terminal of the direct current motor, and third and fourth relays selectively driven upon receiving a control signal from the controller so that a voltage of a second polarity opposite to the first polarity is applied to a second terminal of the direct current motor.

8. The traveling equipment of claim 1, wherein the traveling motor is an alternating current motor, and the driving device forms a closed loop when a first terminal of an alternating current motor is constantly connected to an alternating current power source, and a second terminal or third terminal of the alternating current motor is selectively connected to the alternating current power source by a pair of relays driven upon selectively receiving a normal direction driving signal or reverse direction driving signal of the controller.

* * * * *